US009396707B1

(12) United States Patent
Clark

(10) Patent No.: US 9,396,707 B1
(45) Date of Patent: Jul. 19, 2016

(54) DEVICE FOR POSITIONING AN ACOUSTIC ACCESSORY INSIDE A STRINGED MUSICAL INSTRUMENT AND METHOD OF USE

(71) Applicant: Jonathan Edward Clark, Aliso Viejo, CA (US)

(72) Inventor: Jonathan Edward Clark, Aliso Viejo, CA (US)

( * ) Notice: Subject to any disclaimer, the term of this patent is extended or adjusted under 35 U.S.C. 154(b) by 0 days.

(21) Appl. No.: 14/799,646

(22) Filed: Jul. 15, 2015

(51) Int. Cl.
*G10D 3/02* (2006.01)

(52) U.S. Cl.
CPC ..... *G10D 3/02* (2013.01)

(58) Field of Classification Search
CPC ..... G10D 3/02
See application file for complete search history.

(56) References Cited

U.S. PATENT DOCUMENTS 729,230 A * 5/1903 Smith ..... G10D 3/02 84/277
1,730,565 A * 10/1929 Flintjer ..... E04H 15/62 135/114
2,060,357 A * 11/1936 Williams ..... G10D 3/02 84/296
3,869,952 A * 3/1975 Rowe ..... G10H 3/183 84/727
4,168,647 A * 9/1979 Petillo ..... G10H 3/181 84/114
4,865,380 A * 9/1989 Heitzman-Powell .... B60N 2/44 135/96
5,010,803 A * 4/1991 Donnell ..... G10H 3/18 84/723
5,194,686 A * 3/1993 Winkler ..... G10D 3/12 84/743
5,614,688 A * 3/1997 Donnell ..... G10H 3/181 84/743
5,690,307 A * 11/1997 Joyce ..... B60N 3/101 224/929
6,274,801 B1 * 8/2001 Wardley ..... G10H 3/146 84/275
6,441,292 B1 * 8/2002 Donnell ..... G10H 3/12 84/723
6,441,293 B1 * 8/2002 LaBarbera ..... G10H 3/146 84/290
6,681,661 B2 * 1/2004 Lalonde ..... G10D 3/02 84/267
6,861,581 B2 * 3/2005 Geiger ..... G10D 3/02 84/267
7,015,390 B1 * 3/2006 Rogers ..... G10H 1/32 84/1
7,074,992 B2 * 7/2006 Schmidt ..... G10D 3/02 84/294
7,247,789 B2 * 7/2007 Fishman ..... G10H 1/32 8/723
7,259,308 B2 * 8/2007 Geiger ..... G10D 3/02 84/267
7,390,950 B2 * 6/2008 Hollander ..... H04R 1/08 84/290
7,674,963 B1 * 3/2010 Poggi ..... G10D 3/02 84/312 R
7,842,867 B2 * 11/2010 Schmidt ..... G10D 3/02 84/267
8,035,025 B1 * 10/2011 Donnell ..... H10H 3/18 84/290
8,835,734 B2 * 9/2014 Schmidt ..... G10D 13/021 84/411 R
9,196,230 B1 * 11/2015 Elliot ..... G10D 3/02
2010/0083806 A1 * 4/2010 Peavey ..... G10D 3/02 84/294
2011/0211713 A1 * 9/2011 Cavallo-Romano ... G10H 3/183 381/118

* cited by examiner

*Primary Examiner* — Robert W Horn
(74) *Attorney, Agent, or Firm* — Ted Masters

(57) ABSTRACT

A device is disclosed for positioning an acoustic accessory inside a stringed musical instrument. The stringed musical instrument includes a body having a soundboard, a back, sides, and an internal cavity, the soundboard having a sound hole surrounded by an edge area. The device includes an arm which connects to the edge area, and which also connects to the acoustic accessory. The arm is movable so that the acoustic accessory can be positioned to a desired location inside the internal cavity. The acoustic accessory and its position change the sound produced by the stringed musical instrument.

4 Claims, 6 Drawing Sheets

Fig. 9
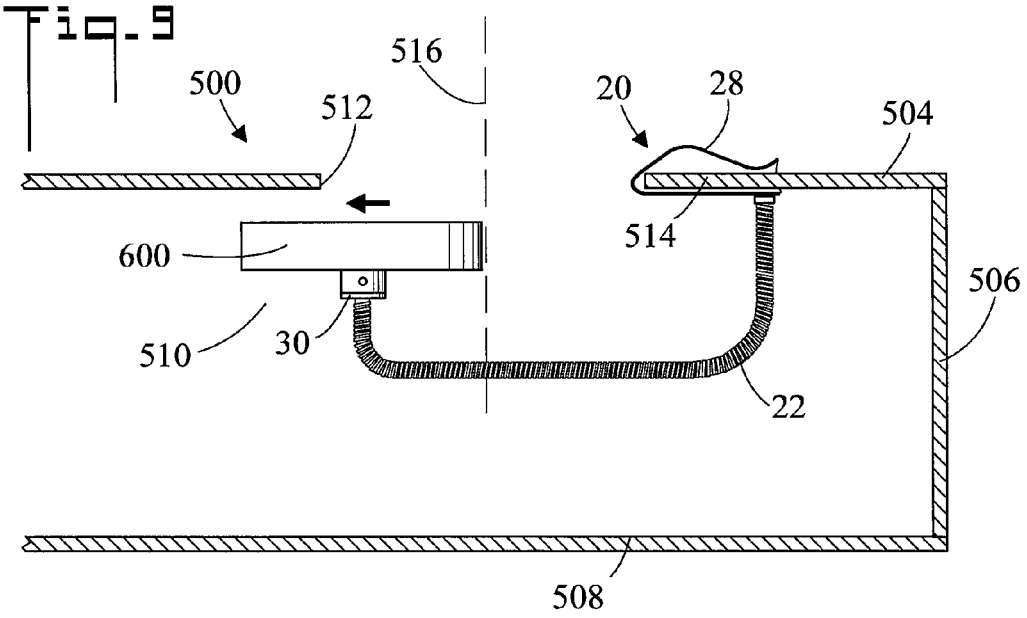
Fig. 10
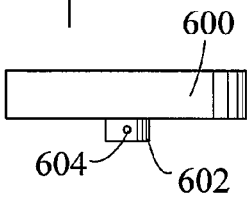
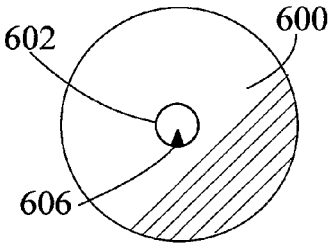
Fig. 11
Fig. 12
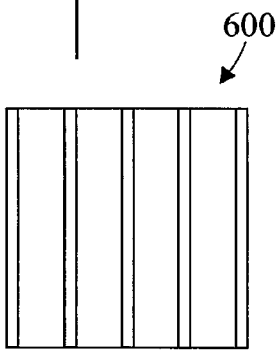
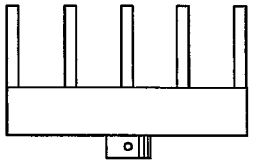
Fig. 13
Fig. 14
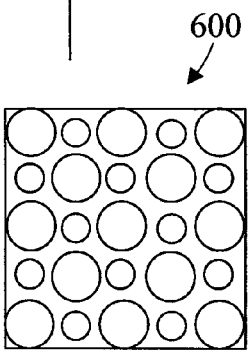
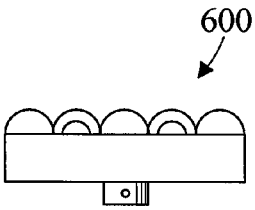
Fig. 15

DEVICE FOR POSITIONING AN ACOUSTIC ACCESSORY INSIDE A STRINGED MUSICAL INSTRUMENT AND METHOD OF USE

CROSS REFERENCE TO RELATED APPLICATION

None

TECHNICAL FIELD

The present invention pertains generally to stringed musical instruments, and more particularly to a device which is used to position an acoustic accessory inside the internal cavity of the stringed musical instrument for the purpose of changing the sound produced by the instrument.

BACKGROUND OF THE INVENTION

Stringed musical instruments are well known in the art. Such instruments include guitars, banjos, ukuleles, and the like. In acoustic stringed instruments the body of the instrument is utilized to transmit the string vibrations through the air. To accomplish this, the body of the instrument employs a sound board having a hole and a sound box having an internal cavity. The vibration energy created by the strings causes the body of the instrument to resonate and amplify the string vibrations. On the other hand, electrical stringed musical instruments utilized electronics to amplify the vibrations of the strings.

BRIEF SUMMARY OF THE INVENTION

The present invention is directed to a device which allows the sound produced by a stringed musical instrument to be changed. The proximal end of a movable arm is connected at the sound hole of the instrument. The distal end of the arm accepts an acoustic accessory. By moving the arm the acoustic accessory can be positioned to a desired location within the sound box of the stringed musical instrument. When so positioned, the acoustic accessory changes (affects) the sound produced by the stringed musical instrument. For example, the acoustic accessory can be designed to absorb, reflect, and/or diffuse certain frequencies, thereby changing the volume and harmonic content of the sound produced by the instrument. As such a listener hears a different sound than would normally be produced by the stringed musical instrument.

In accordance with an embodiment, a device is disclosed for positioning an acoustic accessory inside a stringed musical instrument, the stringed musical instrument including a body having a soundboard, a back, sides, and an internal cavity, the soundboard having a sound hole surrounded by an edge area. The device includes an arm having a first end and an opposite second end. A soundboard connector is disposed at the first end of the arm, the soundboard connector is shaped and dimensioned to removably connect to the edge area of the soundboard. The arm is movable with respect to the soundboard connector. An acoustic accessory connector is disposed at the second end of the arm, the acoustic accessory connector is shaped and dimensioned to removably connect to the acoustic accessory. When the acoustic accessory is connected to the acoustic accessory connector, and when the soundboard connector is connected to the edge area of the soundboard, and when the acoustic accessory is placed inside the internal cavity, the arm is movable within the internal cavity so that the acoustic accessory can be positioned to a desired location inside the internal cavity.

In accordance with another embodiment, the arm is a flexible gooseneck arm.

In accordance with another embodiment, the sound hole has a centerline. The arm is movable so that the acoustic accessory is substantially centered on the centerline of the sound hole, and is positionable to multiple locations between the soundboard and the back.

In accordance with another embodiment, the arm is movable so that the acoustic accessory is not centered on the centerline of the sound hole.

In accordance with another embodiment, the acoustic accessory includes a keyed connector, and the acoustic accessory connector is keyed so that it connects to the keyed connector of the acoustic accessory.

In accordance with another embodiment, the soundboard connector is a clip.

In accordance with another embodiment, the arm and the acoustic accessory connector are both shaped and dimensioned to fit through the sound hole of the stringed musical instrument.

Other embodiments, in addition to the embodiments enumerated above, will become apparent from the following detailed description, taken in conjunction with the accompanying drawings, which illustrate, by way of example, the principles of the device and method of use.

BRIEF DESCRIPTION OF THE DRAWINGS

FIG. 9 is an enlarged cutaway view as in FIG. 7 with the acoustic accessory moved to another different position;

FIG. 10 is a side elevation view of an acoustic accessory;

FIG. 11 is a bottom plan view of the acoustic accessory of FIG. 10;

FIG. 12 is a top plan view of a second acoustic accessory;

FIG. 13 is a side elevation view of the second acoustic accessory;

FIG. 14 a top plan view of a third acoustic accessory;

FIG. 15 is a side elevation view of the third acoustic accessory; and,

DETAILED DESCRIPTION OF THE INVENTION

Figure 1:
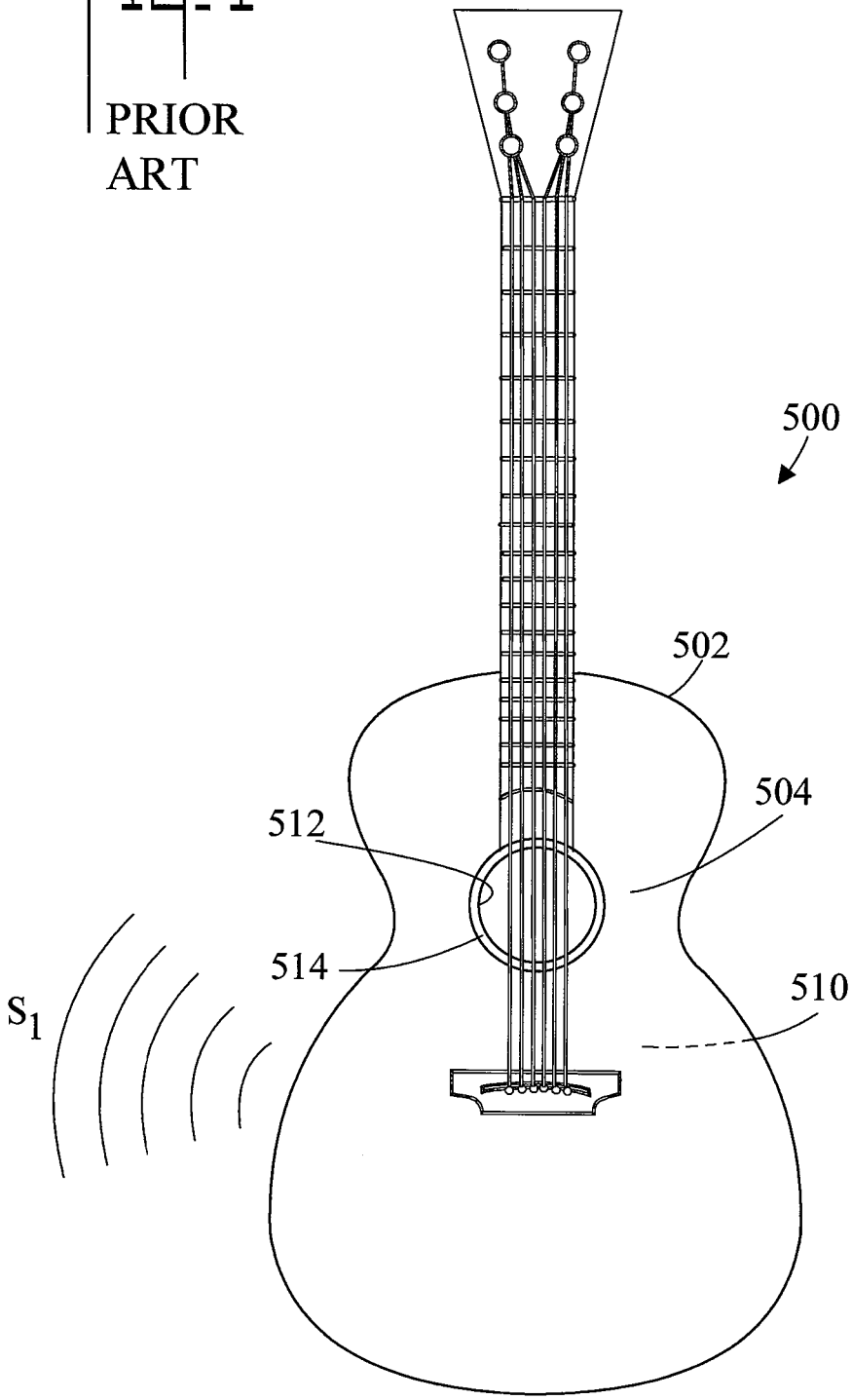
Fig. 1 PRIOR ART
FIG. 1 is a top plan view of a prior art stringed musical instrument.

Referring initially to FIG. 1, there is illustrated a top plan view of a prior art stringed musical instrument, generally designated as 500. In the shown embodiment, stringed musical instrument 500 is an acoustic guitar which has a body 502 having a soundboard 504, a back 508 (refer to FIG. 7), sides 506 (refer to FIG. 7), and an internal cavity 510. Soundboard 504 has a sound hole 512 surrounded by an edge area 514 (the circular area of soundboard 504 which surrounds sound hole 512). Soundboard 504, back 508, and sides 506 combine to form a sound box. When played, stringed musical instrument 500 produces sound $S_1$.

Figure 2:
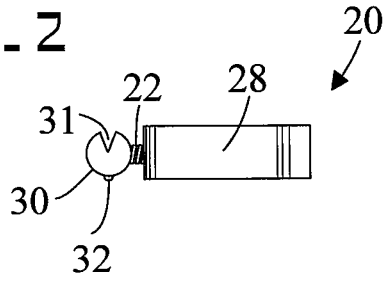
FIG. 2 is a top plan view of a device for positioning an acoustic accessory inside the stringed musical instrument.
Figure 4:
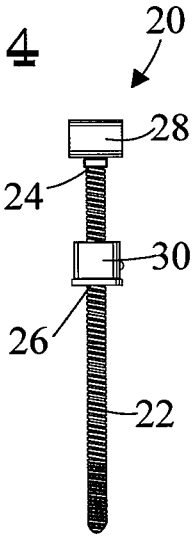
FIG. 4 is an end elevation view of the device.
Figure 3:
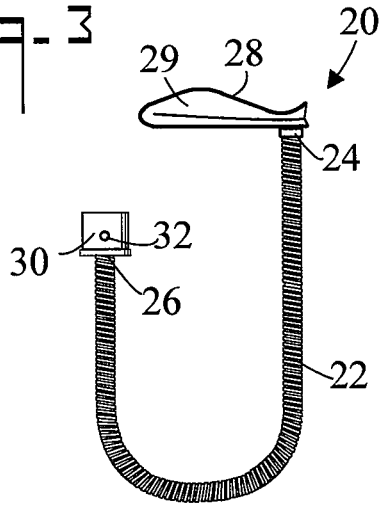
FIG. 3 is a side elevation view of the device.
Figure 5:
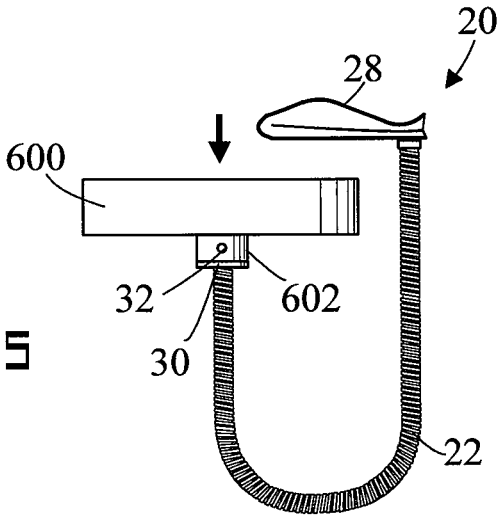
FIG. 5 is a side elevation view of the device with an acoustic accessory attached.

FIGS. 2-4 are top plan, side elevation, and end elevation views respectively of a device for positioning an acoustic accessory inside stringed musical instrument 500, the device generally designated as 20. FIG. 5 is a side elevation view of device 20 with an acoustic accessory 600 attached. Device 20 includes an arm 22 having a first end 24 and an opposite second end 26. A soundboard connector 28 is disposed at first end 24 of arm 22. Soundboard connector 28 is shaped and dimensioned to removably connect to the edge area 514 of soundboard 504. In the shown embodiment soundboard connector 28 is a clip which is biased to a closed position and which can be connected to edge area 514, the clip having padding 29 so as not to mare edge area 514.

Acoustic accessory 600 is placed inside internal cavity 510 and changes the sound produced by body 502 of stringed musical instrument 500. The sound can be changed by moving acoustic accessory 600 to different locations within internal cavity 510. Acoustic accessory 600 can be any size and shape, and can be fabricated from a material which diffuses the sound or which absorbs the sound, or a combination of both (refer to FIGS. 12-15). In the shown embodiment acoustic accessory 600 is disc shaped.

Arm 22 is movable with respect to soundboard connector 28 (refer also to FIGS. 7-9), so that acoustic accessory 600 can be placed in a desired location within internal cavity 510. In the shown embodiment arm 22 is a flexile gooseneck arm such as that used to position lights and other devices. Arm 22 can be manually moved (adjusted) to a desired position, and when released will remain in the desired position. Subsequently, arm 22 can be moved to a different position, and will remain in that position when released. It may be appreciated however that other types of movable arms 22 such as pivoting arms and telescoping arms could also be utilized.

An acoustic accessory connector 30 is disposed at second end 26 of arm 22, and is shaped and dimensioned to removably connect to acoustic accessory 600. Referring also to FIGS. 5, 10, and 11, in the shown embodiment, acoustic accessory connector 30 is a cylindrical member which fits into a cylindrical socket (sleeve) 602 of acoustic accessory 600. The acoustic accessory connector 30 has a detent spring 32 which cooperates with a hole 604 in socket 602 to effect the connection. It may be appreciated however that other connection means such as screws could also be employed. In FIG. 5, acoustic accessory 600 has been connected to acoustic accessory connector 30. Also in the shown embodiment, acoustic connector 30 is keyed so that it can connect to the also keyed cylindrical socket 602 of acoustic accessory 600. As shown the keying feature is implemented by a cutout portion 31 of acoustic accessory connector 30 which receives cooperating solid portion 606 of acoustic cylindrical socket 602 of acoustic accessory 600. This keying feature only allows properly keyed acoustic accessories 600 to be connected to device 20.

Figure 6:
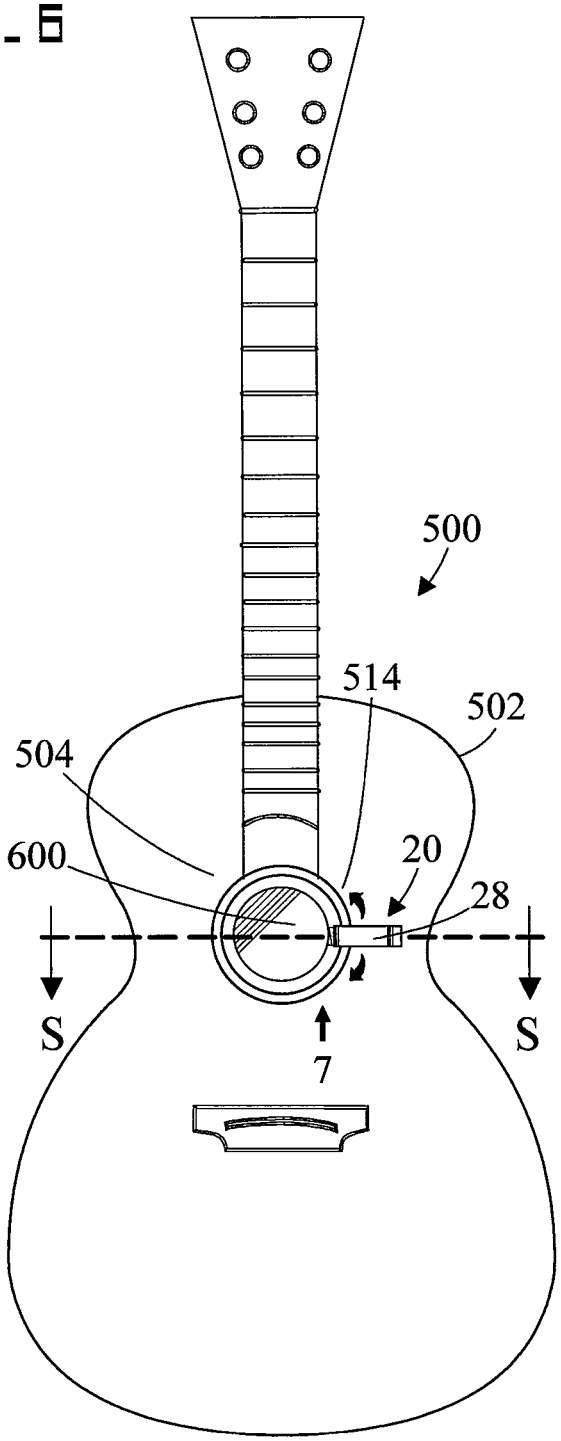
FIG. 6 is top plan view of the prior art stringed musical instrument with the strings removed and the device and acoustic accessory attached.
Figure 7:
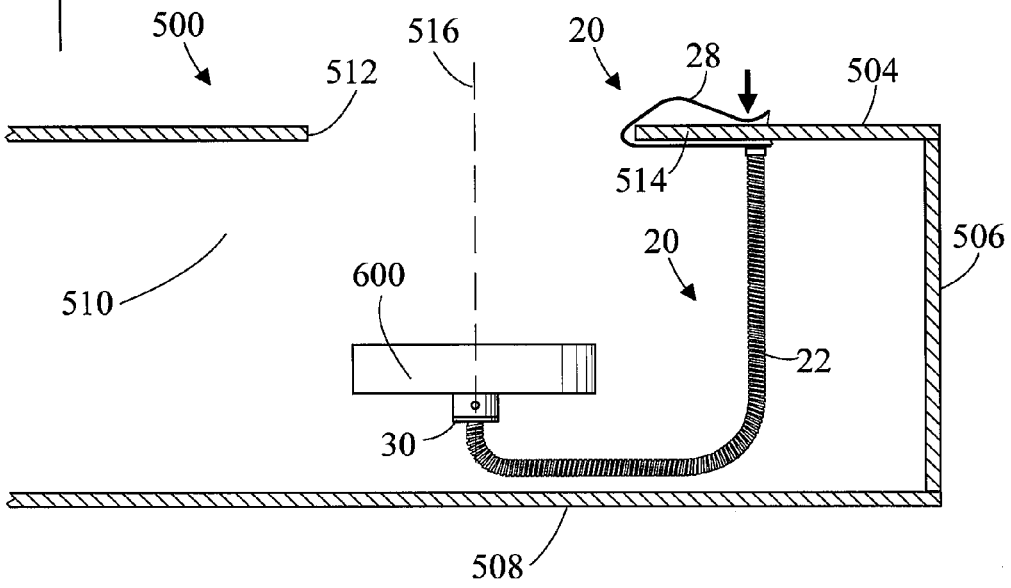
FIG. 7 is an enlarged cutaway view in direction 7 of FIG. 5.
Figure 8:
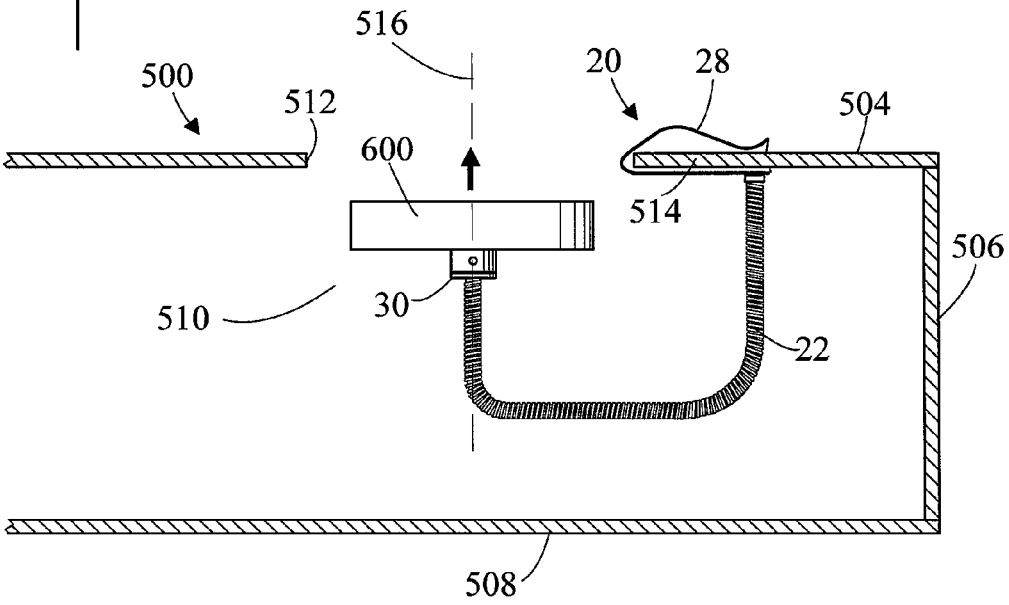
FIG. 8 is an enlarged cutaway view as in FIG. 7 with the acoustic accessory moved to a different position.

Referring also to FIG. 6-8, when acoustic accessory 600 is connected to acoustic accessory connector 30, and when soundboard connector 28 is connected to edge area 514 of soundboard 504, and when acoustic accessory 600 is placed inside internal cavity 510, arm 22 is movable within internal cavity 510 so that acoustic accessory 600 can be positioned to a desired location inside internal cavity 510.

FIG. 6 is top plan view of prior art stringed musical instrument 500 with the strings removed and device 20 attached. Soundboard connector 28 has been connected to edge area 514 of soundboard 504. In most cases the strings of stringed musical instrument 500 will have to be removed to install soundboard connector 28 and to insert arm 22 and acoustic accessory 600 through sound hole 512 and into internal cavity 510. However, depending upon the particular stringed musical instrument 500 and the design of device 20, in some instances it may be possible to install device 20 by simply loosening the strings of the instrument. Moreover, it is noted that soundboard connector 28 can be slid around edge area 514 to other mounting locations, as indicated by the arrows.

FIG. 7 is an enlarged cutaway view in direction 7 of FIG. 5. In this view the entire bottom section S of body 502 has been removed so that device 20 and acoustic accessory 600 can be seen. FIG. 8 is an enlarged cutaway view as in FIG. 7 with acoustic accessory 600 moved to a different position. It is noted that arm 22 and acoustic accessory connector 28 are both shaped and dimensioned to fit through sound hole 512 of stringed musical instrument 500. Similarly, acoustic accessory 600 must be able to fit through sound hole 512. Soundboard connector 28 has been connected (clipped as shown) to edge area 514 of soundboard 504, with arm 22, acoustic accessory connector 30, and acoustic accessory 600 all extending into internal cavity 510. As shown, sound hole 512 has a centerline 516, and arm 22 is movable so that acoustic accessory 600 is substantially centered on centerline 512 of sound hole 512. Acoustic accessory 600 is positionable to multiple locations between soundboard 504 and back 508. In FIG. 7 acoustic accessory 600 is disposed toward back 508, and in FIG. 8 acoustic accessory 600 is moved up toward soundboard 504. These different positions of acoustic accessory 600 result in different sounds being produced by stringed musical instrument 500.

FIG. 9 is an enlarged cutaway view as in FIG. 7 with acoustic accessory 600 moved to another different position. In this instance arm 22 is movable so that acoustic accessory 600 is not centered on centerline 516 of sound hole 512.

FIGS. 10 and 11 are side elevation and bottom plan views respectively of acoustic accessory 600. In this embodiment, acoustic accessory 600 is a disc which has a keyed connector 602, the key being the triangular area 606.

FIGS. 12 and 13 are top plan and side elevation views respectively of a second acoustic accessory 600, and FIGS. 14 and 15 are top plan and side elevation views respectively of a third acoustic accessory 600. Acoustic accessory 600 can (1) be of various sizes and shapes, (2) be fabricated from diffusive and/or absorptive material, (3) be a passive device, and (4) be an active device which contains electronics. The specific design of acoustic accessory 600 determines how the accessory affects the sound produced by stringed musical instrument 500.

Figure 16:
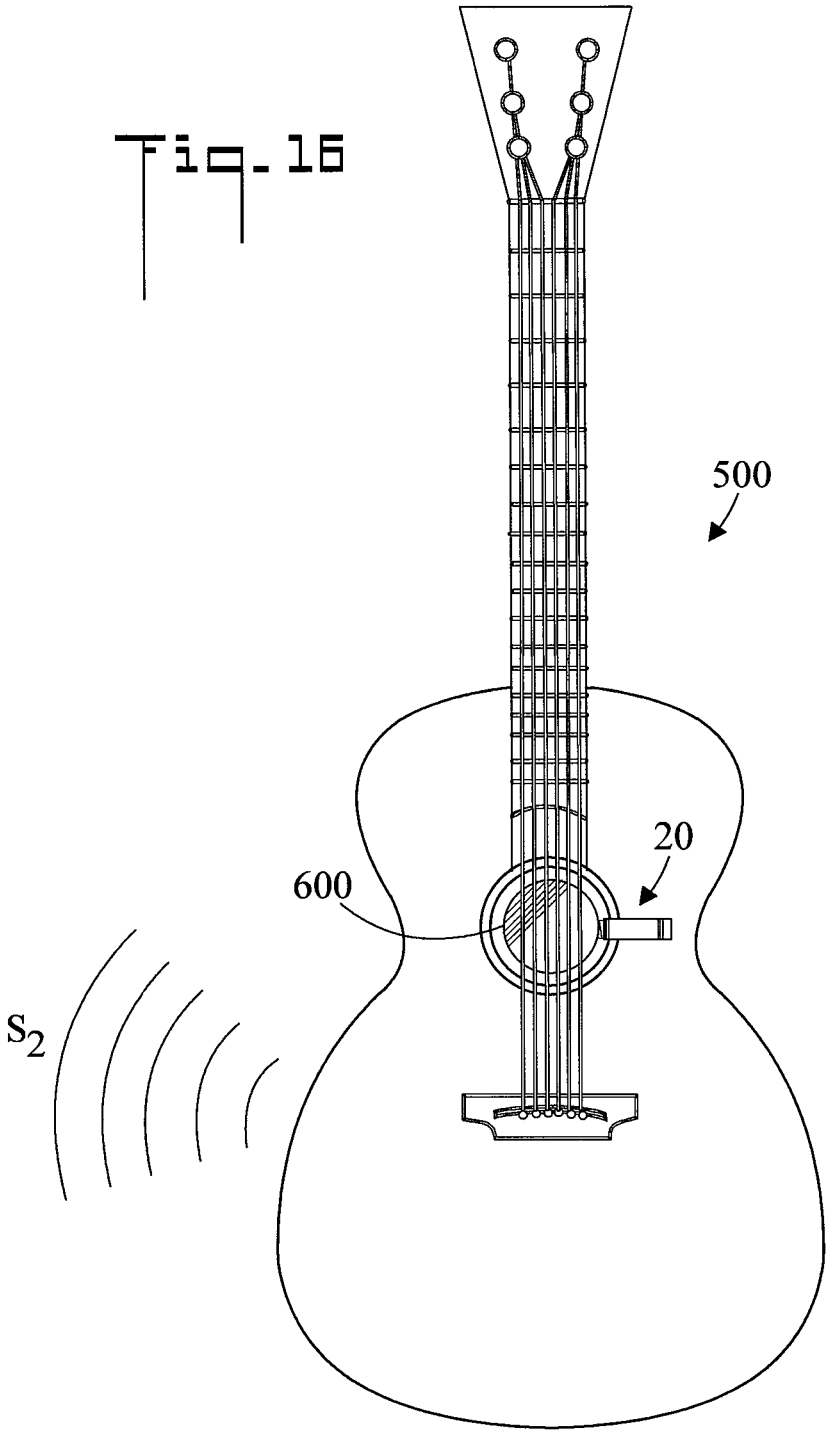
FIG. 16 is a top plan view of the stringed instrument restrung with the device and acoustic accessory installed.

FIG. 16 is a top plan view of stringed instrument 500 restrung with device 20 and acoustic accessory 600 installed. When played, stringed musical instrument 500 now produces sound $S_2$ which is different from sound $S_1$ produced without acoustic accessory 600.

In another embodiment, device 20 is combined with acoustic accessory 600 to form a system for changing the sound of a stringed musical instrument 500.

In terms of use, a method for changing the sound of a stringed musical instrument 500 includes:

(a) providing a stringed musical instrument 500 including a body 502 having a soundboard 504, a back 508, sides 506, and an internal cavity 510, soundboard 504 having a sound hole 512 surrounded by an edge area 514;

(b) providing a system for changing the sound of the stringed musical instrument 500, including:

an acoustic accessory 600, which when positioned inside the internal cavity 510 of the stringed musical instrument 500, changes the sound of the stringed musical instrument 500;

a device 20 for positioning the acoustic accessory 600 inside the stringed musical instrument 500, the device 20 including;

an arm 22 having a first end 24 and an opposite second end 26;

a soundboard connector 28 disposed at the first end 24 of the arm 22, the soundboard connector 28 shaped and dimensioned to removably connect to the edge area 514 of the soundboard 504, the arm 22 movable with respect to the soundboard connector 28;

an acoustic accessory connector 30 disposed at the second end 26 of the arm 22, the acoustic accessory connector 30 shaped and dimensioned to removably connect to the acoustic accessory 600;

when the acoustic accessory 600 is connected to the acoustic accessory connector 30, and when the soundboard connector 28 is connected to the edge area 514 of the soundboard 504, and when the acoustic accessory 600 is placed inside the internal cavity 510, the arm 22 is movable within the internal cavity 510 so that the acoustic accessory 600 can be positioned to a desired location inside the internal cavity 510;

(c) connecting the acoustic accessory connector 30 to the acoustic accessory 600;

(d) connecting the soundboard connector 28 to the edge area 514 of the soundboard 504;

(e) moving the arm 22 so that the arm 22 and the acoustic accessory 600 are disposed within the internal cavity 510 of the stringed musical instrument 500; and, (f) moving the arm 22 until the acoustic accessory 600 is positioned to a desired location within the internal cavity 510 of the stringed musical instrument 500.

Note: Steps (c) and (d) can be reversed, wherein acoustic accessory 600 can be connected to the acoustic accessory connector 30 after the soundboard connector 28 is connected to the edge area 514.

The method further including:

after (f), moving the arm 22 so that the acoustic accessory 600 is positioned to a different location within the internal cavity 510 of the stringed musical instrument 500.

The method further including:

before (d), unstringing the stringed musical instrument 500; and, after (f), restringing the stringed musical instrument 500.

The method of further including:

in (b), the arm 22, the acoustic accessory connector 30, and the acoustic accessory 600 all being shaped and dimensioned to fit through the sound hole 512 of the stringed musical instrument 500.

The embodiments of the device, system, and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the device, system, and method should be construed as limiting the invention to a particular embodiment or combination of embodiments. The scope of the invention is defined by the appended claims.

I claim:

1. Method for changing the sound of a stringed musical instrument, comprising:

(a) providing a stringed musical instrument including a body having a soundboard, a back, sides, and an internal cavity, said soundboard having a sound hole surrounded by an edge area;

(b) providing a system for changing the sound of said stringed musical instrument, including:

an acoustic accessory, which when positioned inside said internal cavity of said stringed musical instrument, changes the sound of said stringed musical instrument;

a device for positioning said acoustic accessory inside said stringed musical instrument, said device including;

an arm having a first end and an opposite second end;

a soundboard connector disposed at said first end of said arm, said soundboard connector shaped and dimensioned to removably connect to said edge area of said soundboard, said arm movable with respect to said soundboard connector;

an acoustic accessory connector disposed at said second end of said arm, said acoustic accessory connector shaped and dimensioned to removably connect to said acoustic accessory; and, when said acoustic accessory is connected to said acoustic accessory connector, and when said soundboard connector is connected to said edge area of said soundboard, and when said acoustic accessory is placed inside said internal cavity, said arm is movable within said internal cavity so that said acoustic accessory can be positioned to a desired location inside said internal cavity;

(c) connecting said acoustic accessory connector to said acoustic accessory;

(d) connecting said soundboard connector to said edge area of said soundboard;

(e) moving said arm so that said arm and said acoustic accessory are disposed within said internal cavity of said stringed musical instrument; and, (f) moving said arm until said acoustic accessory is positioned to a desired location within said internal cavity of said stringed musical instrument.

2. The method of claim 1, further including:

after (f), moving said arm so that said acoustic accessory is positioned to a different location within said internal cavity of said stringed musical instrument.

3. The method of claim 1, further including:

before (d), unstringing said stringed musical instrument; and, after (f), restringing said stringed musical instrument.

4. The method of claim 1, further including:

in (b), said arm, said acoustic accessory connector, and said acoustic accessory all being shaped and dimensioned to fit through said sound hole of said stringed musical instrument.

* * * * *